US006591989B2

(12) United States Patent
McNeill

(10) Patent No.: US 6,591,989 B2
(45) **Date of Patent: *Jul. 15, 2003**

(54) DISPLAY SLEEVE ENCLOSURE FOR A DISPENSING CONTAINER

(76) Inventor: Allen R. McNeill, 871 Twin Pine Dr., Kirkwood, MO (US) 63122

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/500,818

(22) Filed: Feb. 10, 2000

(65) Prior Publication Data

US 2001/0052477 A1 Dec. 20, 2001

(51) Int. Cl.[7] ..... B65D 73/00
(52) U.S. Cl. ..... 206/494; 229/162
(58) Field of Search ..... 206/494, 233, 206/459.5, 457; 221/305, 45, 61, 63; D6/518–523; 53/456; 229/162, 120.22, 779

(56) References Cited

U.S. PATENT DOCUMENTS

| | | | | | |
|---|---|---|---|---|---|
| 176,341 | A | | 4/1876 | Osbourn | |
| D30,089 | S | | 1/1899 | Zuck | |
| 2,107,826 | A | | 2/1938 | Keller | |
| 3,384,224 | A | * | 5/1968 | Buckholz et al. | D6/518 |
| 3,970,215 | A | * | 7/1976 | McLaren et al. | 206/494 |
| 3,979,019 | A | * | 9/1976 | Bliss | 221/48 |
| D244,653 | S | | 6/1977 | Tegner | |
| D254,898 | S | * | 5/1980 | Buerk | D6/269 |
| 4,262,816 | A | | 4/1981 | Margulies | |
| D266,809 | S | * | 11/1982 | Rodriguez | D6/153 |
| D277,169 | S | | 1/1985 | Ito et al. | |
| 4,586,629 | A | | 5/1986 | Loder | |
| 4,586,630 | A | | 5/1986 | Loder | |
| 4,586,631 | A | | 5/1986 | Loder | |
| 4,653,666 | A | | 3/1987 | Mertens | |
| 5,054,612 | A | * | 10/1991 | Meyer, Jr. | 206/233 |
| 5,054,644 | A | | 10/1991 | Greenslade | |
| 5,129,545 | A | | 7/1992 | Parks | |
| 5,184,720 | A | * | 2/1993 | Packer et al. | 206/366 |
| D352,412 | S | * | 11/1994 | Lopez | D6/518 |
| D372,386 | S | | 8/1996 | Kuchenbecker | |
| 5,553,733 | A | * | 9/1996 | Rosenthal | 220/400 |
| D390,391 | S | * | 2/1998 | Hsu | D6/518 |
| 5,746,369 | A | | 5/1998 | McDermott | |
| 5,860,555 | A | | 1/1999 | Mayled | |
| 6,129,239 | A | * | 10/2000 | Fukazawa | 221/61 |
| 6,196,435 | B1 | * | 3/2001 | Wu | 224/572 |

FOREIGN PATENT DOCUMENTS

GB 2236096 A 3/1991

OTHER PUBLICATIONS

Maleck Catalogue, p. 31, (1980).

* cited by examiner

*Primary Examiner*—Shian Luong
(74) *Attorney, Agent, or Firm*—Thompson Coburn, LLP

(57) ABSTRACT

In a combination of a display sleeve and a dispensing container, the dispensing container has a hollow interior volume for holding and dispensing materials and a dispensing opening for allowing materials contained in the interior volume to be passed through the opening to outside the dispensing container. The display sleeve has a body with a hollow interior volume and an installation entrance to the hollow interior of the body. The hollow interior volume of the body is adapted to receive the dispensing container. The display sleeve has an access opening where the access opening is shaped to coincide and match with the dispensing opening when the dispensing container is inserted into the display sleeve.

2 Claims, 6 Drawing Sheets

DISPLAY SLEEVE ENCLOSURE FOR A DISPENSING CONTAINER

BACKGROUND OF THE INVENTION (1) Field of the Invention

The present invention relates to a dispensing container and to a sleeve, which surrounds and covers the dispensing container so that the exterior of the dispensing container is concealed. The sleeve has a custom exterior and can be used to display promotional and advertising materials, or other desired custom exteriors.

(2) Description of the Related Art

Conventional dispensing containers are mass-produced with exteriors having a general appearance designed to appeal to the public at large. For example, tissue boxes have exteriors that are printed with a variety of floral and other graphical designs. These patterns are neutral and designed to be compatible with a variety of styles of interior decor and other fashions. Since these tissue boxes and other dispensing containers are mass-produced, the pictorial designs and graphics are not readily subject to custom changes. Generally, these designs are printed on card stock, and the card stock is then stamped into the required geometry to create a dispensing container. The card stock containing the specific print is also mass-produced. In order to develop a custom or new outer design for an application, the manufacturer of the dispensing container will usually require that the user purchase upwards of 100,000 to 1,000,000 units of the particular dispensing container. This is necessary to offset the large set-up charges in changing the design and changing over a production line to run the user's custom design. This is cost prohibitive, leaving the user who only desires a small number of custom designed dispensing containers with no alternative. Users of other dispensing containers, other than tissue boxes, are faced with the same manufacturing economies of scale.

SUMMARY OF THE INVENTION

The apparatus of the present invention overcomes these disadvantages with regard to customizing the exterior appearance of a mass-produced dispensing container. The apparatus of the present invention is basically the combination of a display sleeve that fits over a dispensing container.

The dispensing container has a hollow interior volume for holding and dispensing materials, for example tissues. The dispensing container has a dispensing opening in the container that allows access to the materials in the interior so that the materials can be manually pulled through the dispensing opening to the outside of the dispensing container.

The display sleeve is a body with a hollow interior volume adapted to receive the dispensing container in a tight fit therein so that the dispensing container is held stationary in the display sleeve. The display sleeve has an access hole that is positioned on the display sleeve and shaped to coincide and match with the dispensing opening of the dispensing container when the dispensing container is inserted into the display sleeve. When placed in the display sleeve, materials can be pulled from the interior volume of the dispensing container through the dispensing opening of the container, through the access hole of the sleeve and outside the display sleeve. In this way, the display sleeve conceals the dispensing container so that the exterior appearance of the dispensing container, except for the dispensing opening, is concealed and housed within the interior volume of the display sleeve. Since the display sleeve can be manufactured more cost effectively in lower lot quantities than can the dispensing container and dispensing materials, the display sleeve exterior can be printed using custom designs and custom graphics as desired by a user. Thus, the display sleeve allows custom changes to the exterior appearance of the dispensing container in a cost-effective manner without disrupting mass production of the dispensing container. Preferably, such a display sleeve is made of a single unitary blank where the blank is formed from cardstock.

In another aspect of the invention, the display sleeve to be used with the dispensing container is formed from a single unitary blank of card stock and folded into a box. The box has a top panel and a bottom panel with four face panels extending between the top and bottom panels. The four face panels are comprised of opposite left and right side panels operably attached to opposite front and back panels. The left and right side panels, the front and back panels, and the bottom panel define an interior of the box.

The top panel is provided with an access hole. The top panel is hinged to the back panel along a top panel hinge line for pivotal movement between a closed position in which the top panel extends from the top panel hinge line to the front panel, and an open position in which the top panel is displaced from the front panel to provide an installation entrance to the box interior through which the dispensing container can be received.

The left and right side panels each have a top flap hinged to the respective left and right side panels along a top flap hinge line. Each of the top flaps pivots about its respective hinge line between a closed position in which each of the top flaps extends from its respective hinge line over the installation entrance toward the opposite top flap, and an open position in which each of the top flaps is displaced from the installation entrance to provide access to the box interior. Each of the top flaps has a distal edge opposite its hinge line that is curved to conform and match with the access hole in the top panel when the top panel is in the closed position.

Yet, another aspect of the invention includes a method of changing the exterior appearance of a dispensing container. The dispensing container in this invention has a dispensing opening to allow contents of the dispensing container to be passed through the dispensing opening from within the dispensing container to outside the dispensing container. In this method, the display sleeve is provided with a desired exterior print. The dispensing container is inserted into the display sleeve such that the exterior appearance of the dispensing container is concealed by the display sleeve and the desired exterior print of the display sleeve is displayed. The dispensing opening of the dispensing container is aligned with the coinciding access hole provided in the display sleeve by moving the top flaps and the top panel to their closed positions, whereby the access hole coincides with the dispensing opening to allow the contents of the dispensing container to be passed from within the dispensing container to outside the display sleeve. The dispensing container is secured inside the display sleeve by closing the top flaps and the top panel.

BRIEF DESCRIPTION OF THE SEVERAL VIEWS OF THE DRAWINGS

Further objects and features of the invention are revealed in the following detailed description of the preferred embodiment of the invention and in the drawings wherein.

Corresponding reference characters indicate corresponding parts throughout the several views of the drawings.

DETAILED DESCRIPTION OF THE INVENTION

Figure 1:
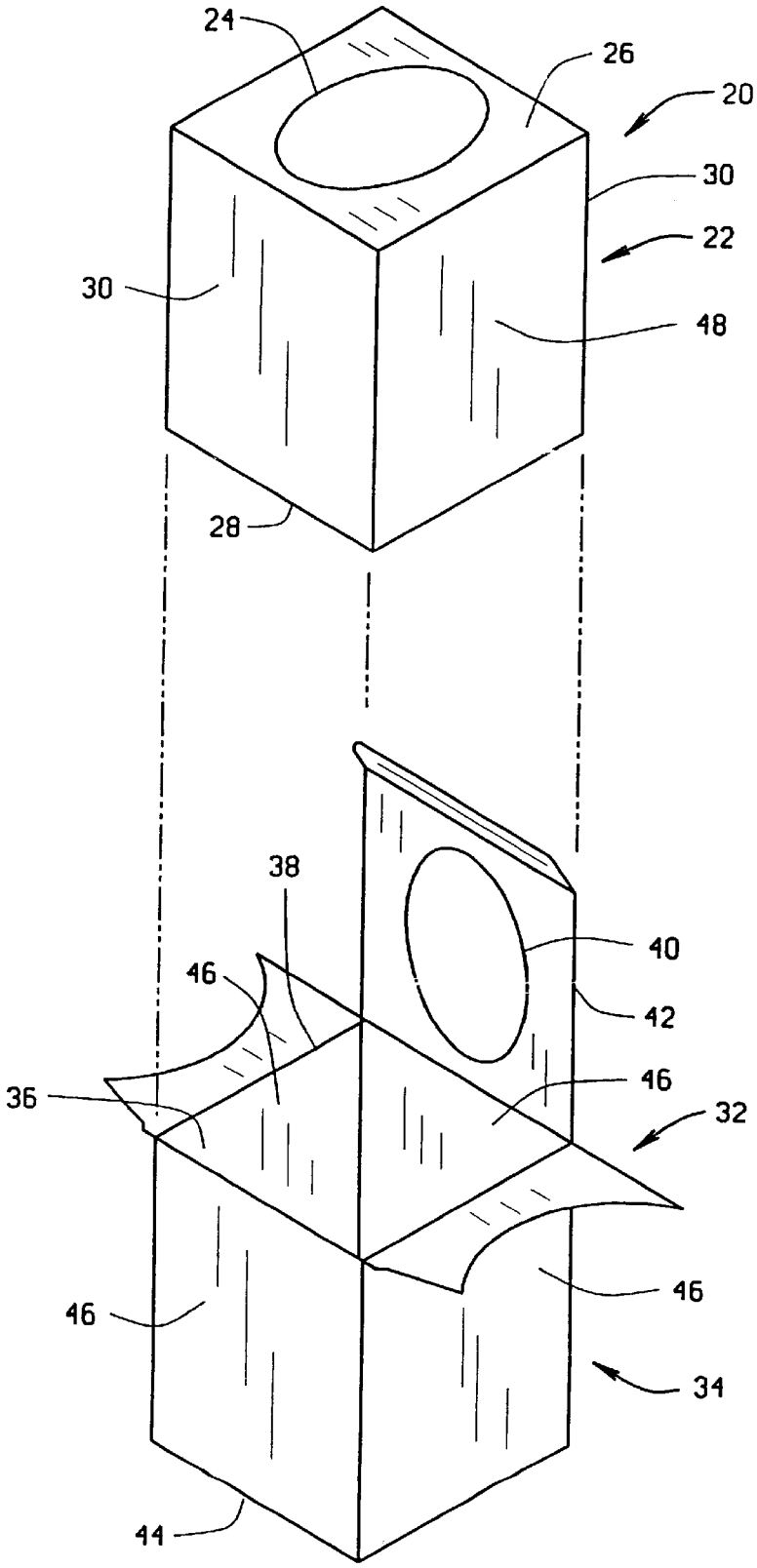
FIG. 1 is a perspective exploded view of a display sleeve and a dispensing container.

FIG. 1 shows the preferred embodiment of the present invention that is comprised of a dispensing container and a display sleeve. The dispensing container 20 is a body 22, having a hollow interior volume that holds and dispenses materials, for example tissues. The dispensing container has a dispensing opening 24 that is designed to allow the contents of the dispensing container to be passed from within the hollow interior volume of the dispensing container 20 through the dispensing opening 24 to outside the dispensing container 20. As shown in FIG. 1, the dispensing container 20 has a box shape with a top 26 and bottom 28 and four sides 30 extending between the top 26 and bottom 28. However, the combination of the invention may comprise other dispensing containers having different shapes.

FIG. 1 also shows the display sleeve 32. The display sleeve 32 is a body 34 with a hollow interior volume 36 and an installation entrance 38 opening to the interior volume 36 of the display sleeve 32 and through which the dispensing container 20 is inserted into the hollow interior volume 36 of the display sleeve 32. The display sleeve 32 is provided with an access hole 40, which matches with and conforms to the opening 24 of the dispensing container when the dispensing container 20 is installed in the hollow interior volume 36 of the display sleeve. Since the access hole 40 matches with and conforms to the dispensing opening 24, the access hole 40 allows the contents of the dispensing container 20 to be pulled from within the dispensing container 20, through the dispensing opening 24 and the access hole 40 to outside the display sleeve 32.

The display sleeve 32 of the present invention has a general shape that matches the shape of the dispensing container 20. In FIG. 1, the display sleeve 32 is shown as a box 41 with top 42 and bottom 44 panels and four face panels 46 extending therebetween. The shape and size of the dispensing container 20 dictates the shape and size of the display sleeve 32 with the primary consideration being keeping the dispensing container 20 stationary within the display sleeve 32. As will become apparent to those skilled in the art, the exterior appearance of other dispensing containers having different sizes and shapes may be covered and concealed in much the same way as described in the following discussion.

Figure 2:
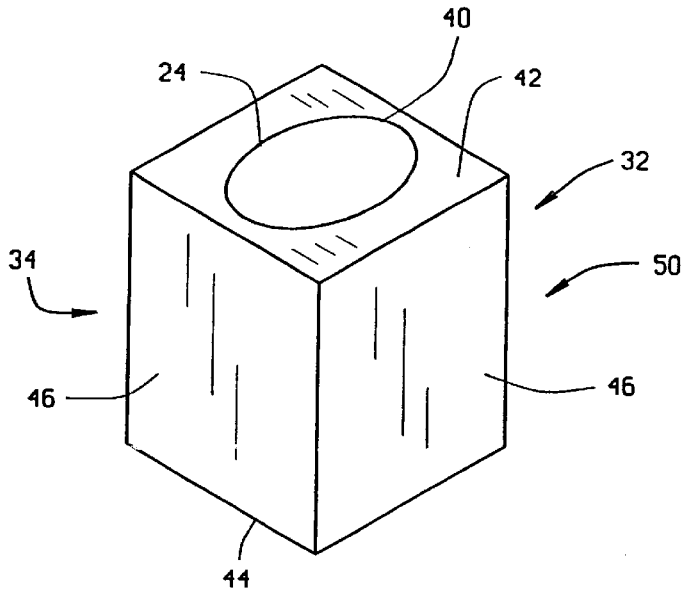
FIG. 2 is a perspective view of the display sleeve of FIG. 1 with the dispensing container of FIG. 1 installed in the display sleeve.
Figure 3A:
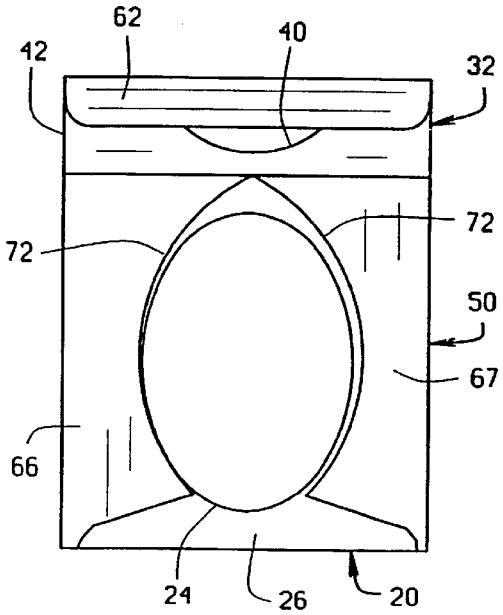
FIG. 3*a* is a top plan view of the display sleeve of FIG. 2 wherein the dispensing container is installed in a hollow interior volume of the display sleeve and top flaps of the display sleeve are moved to closed positions so that curved distal edges of the flaps conform and match with an opening of the dispensing container.
Figure 3B:
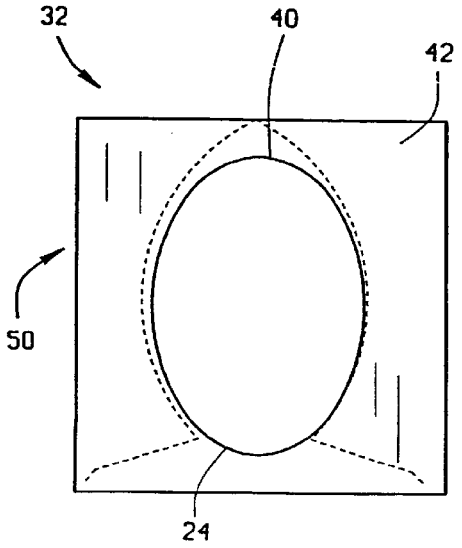
FIG. 3*b* is a top plan view of the display sleeve of FIG. 3*a* wherein a top panel of the display sleeve closes an installation opening to the sleeve and an access hole in the top panel conforms and matches with the opening of the dispensing container.

As shown in FIGS. 1–8 and as referred to earlier, a common use for the display sleeve 32 is to cover and conceal a tissue box. The dimensions of the interior volume of the display sleeve 32 closely match the exterior dimensions of the dispensing container 20. In this way the dispensing container 20 can be inserted into the interior volume 36 of the display sleeve and the display sleeve can conceal the exterior appearance 48 of the dispensing container 20. Since the access hole 40 matches with and coincides with the dispensing opening 24, the top most portion of the dispensing container 20 is also concealed except for the opening 24 through which contents of the dispensing container 20 can be passed. FIGS. 2 and 3 show a preferred embodiment of the apparatus of the present invention in which the display sleeve 32 entirely envelopes the dispensing container 20 except for the dispensing opening 24. By constructing the display sleeve 32 as a box that matches the box-like structure of the dispensing container 20, the dispensing container 20 can be securely held within the display sleeve 32. Thus, the combination display sleeve 32 and installed dispensing container 20 can be moved as a unit 50 without disturbing the contents of either of the display sleeve 32 or the dispensing container 20.

Figure 4:
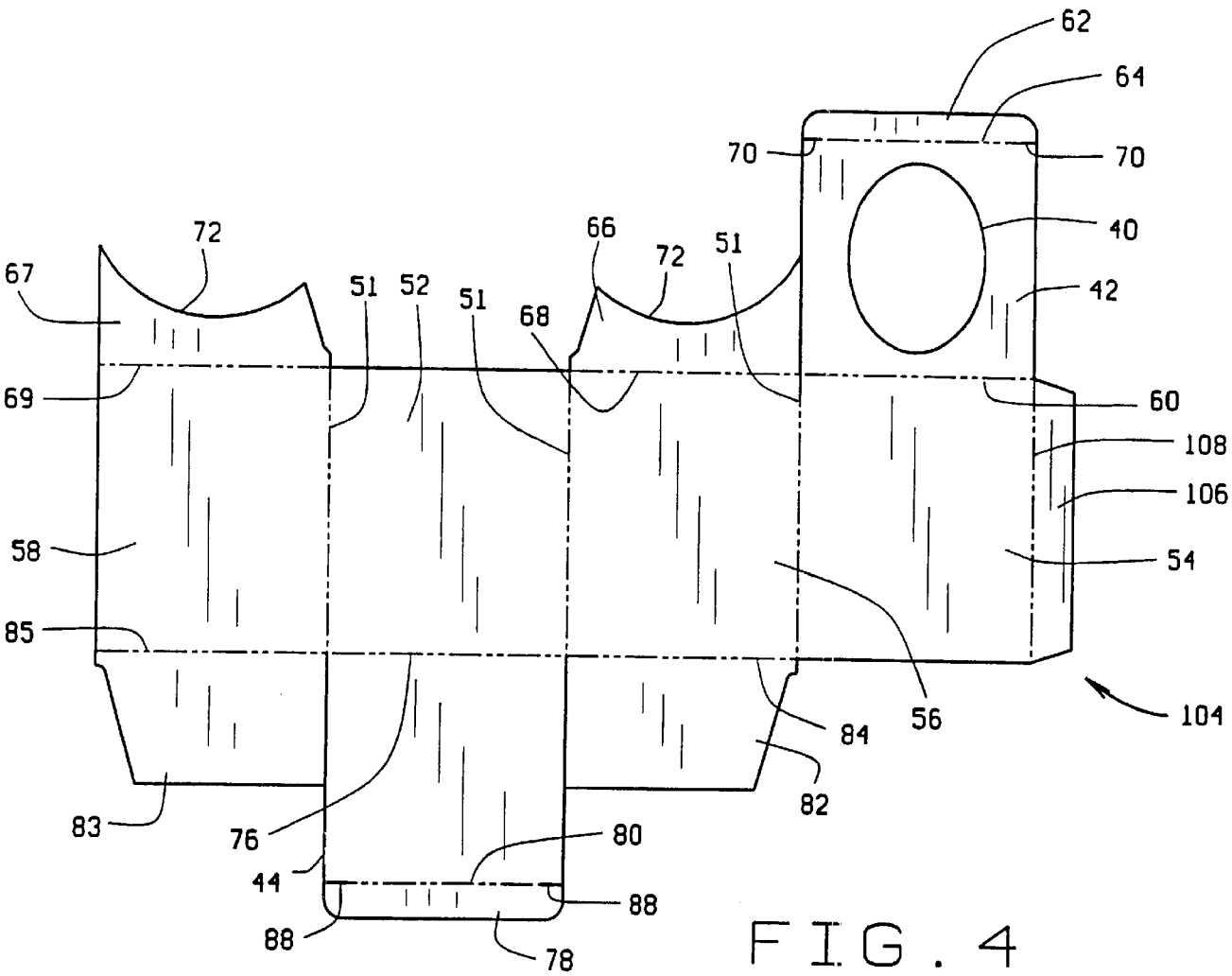
FIG. 4 is a top plan view of a blank from which the display sleeve of FIG. 1 is constructed, the blank using a panel engagement means comprising a single tab to secure the blank in the box shape of FIG. 1.
Figure 5:
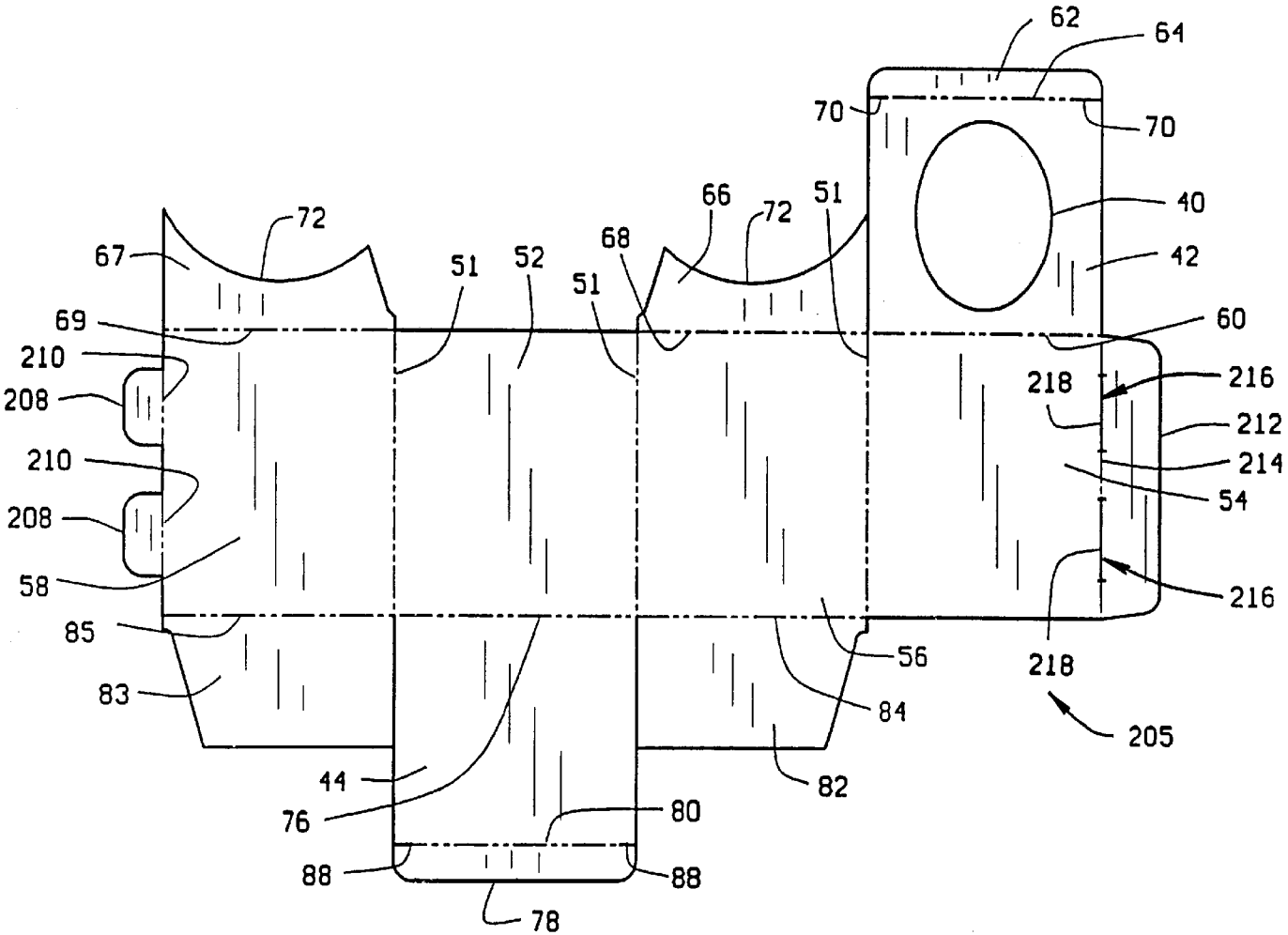
FIG. 5 is a top plan view of an alternate embodiment of the blank of FIG. 4 using a panel engagement means comprising two right side panel tabs with two complementing slots on the adjacent panel to secure the blank in the box shape of FIG. 1.
Figure 6:
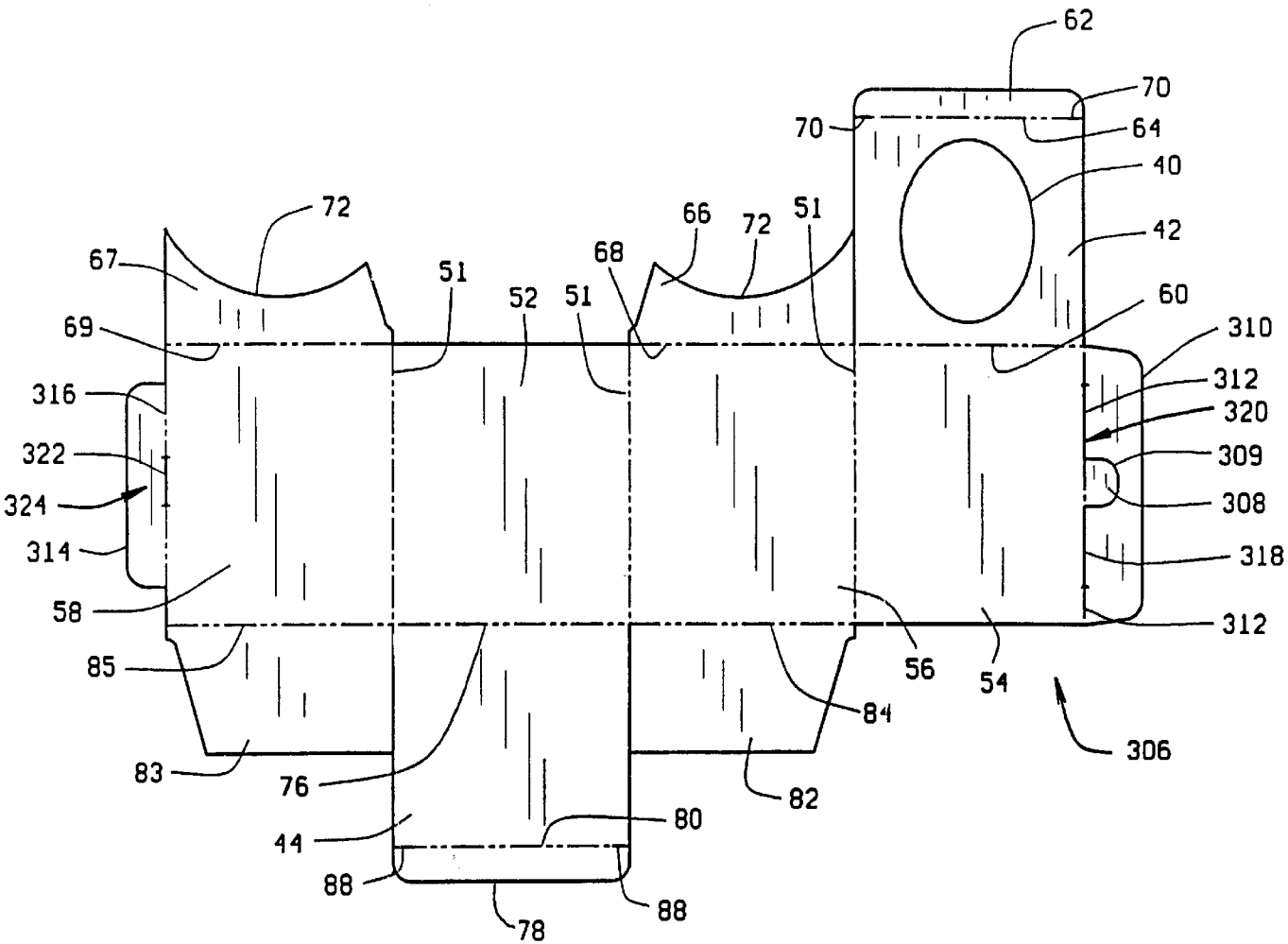
FIG. 6 is a top plan view of an alternate embodiment of the blank of FIG. 4 using a panel engagement means comprising a set of complementing tabs and slots on adjacent panels to secure the blank in the box shape of FIG. 1.

To create an inexpensive box 41 for the display sleeve 32, a flat stock blank is used. Preferably, card stock is used for the blank, since card stock is light-weight, easily folded, and adaptable to many printing methods. The blank is a single unitary blank. FIGS. 4, 5, and 6 show alternative embodiments of the stock blank for constructing the display sleeve 32 of the present invention. Although FIGS. 4, 5 and 6 show different stock blanks for forming the box for the display sleeve 32, these figures are to not be viewed as limiting and only as representing possible methods of constructing the display sleeve 32 of the current invention. Other patterns of blanks may be used as may become apparent to those skilled in the art given the different shapes of dispensing containers that are available in the marketplace.

When designing a display sleeve based on the varying geometry of the many dispensing containers available in the marketplace, the relative size of each of the respective face panels and their relative orientation may change from the description contained herein. The use of the descriptive terms "top", "bottom", "left", and "right" are for illustrative purposes only and are not intended to limit the display sleeve of the invention to any particular orientation in use of the display sleeve. Moreover, the terms "top", "bottom", "left", and "right" used in the following discussion have been adopted for the sake of clarity when referring to the drawings and are not intended to limit the actual construction of the apparatus of the invention.

Consistent among the alternate embodiments shown in FIGS. 4, 5, and 6 is the box that can be formed by folding the stock blank. As previously described, the display sleeve 32, preferably is a box having top 42 and bottom panels with four face panels 46 extending between the top and bottom panels 42,44. As shown in FIGS. 4, 5, and 6, each of the unitary blanks 104,205,306 has partition fold lines 51 partitioning the face panels into opposite front 52 and back 54 panels that are operably attached to opposite left 56 and right 58 side panels. When folded across the partition fold lines 51, together the front and back panels 52,54, left and right side panels 56,58 and bottom panel 44 define the box with the hollow interior volume 26 that is dimensioned to receive the dispensing container 20.

As shown in FIGS. 4, 5, and 6, each of the unitary blanks 104,205,306 includes the top panel 42. The top panel 42 is provided to secure and conceal the top 26 of the dispensing container within the display sleeve 32. When forming the display sleeve 32 from a single blank, the top panel 32 is connected to the back panel 54 via a top panel hinge line 60 formed in the stock blank. The top panel hinge line 60 allows for pivotal movement of the top panel 42 between a closed position in which the top panel 42 extends from the top panel hinge line 60 to the front panel 52, and an open position in which the top panel 42 is displaced from the front panel 52 to provide access to the hollow interior volume 36. In this way the top panel 42 forms the installation entrance 38. When the top panel 42 is in the open position, the installation entrance 38 defined by the top-most edges of the front 52 and back 54 panels and the left 56 and right 58 side panels is opened, enabling insertion of the dispensing container into the display sleeve 32.

As shown in FIGS. 4, 5, and 6, each of the unitary blanks 104,205,306 includes a top tab 62, extending from the top panel 42 at a top tab fold line 64 that runs parallel to the top hinge line 60 on the opposite side of the top panel 42. The top tab 62 is configured for releaseably securing the top panel 42 in the closed position to constrain the dispensing container 20 within the hollow interior volume 36 of the display sleeve.

As shown in FIGS. 4, 5, and 6, each of the unitary blanks 104, 205, 306 includes the opposite left and right side panels 56,58. The opposite left and right side panels 56,58 of the display sleeve 32 are also each provided with a respective left and right top flap 66,67. Each of the top flaps 66,67 is hinged to each of the respective side panels 56,58 along a left and right top flap hinge line 68,69. Each of the top flaps 66,67 is configured for pivotable movement along its respective top flap hinge line 68,69 between a closed position in which each of the top flaps 66,67 extends from the respective top flap hinge line 68,69 toward the opposite side panel and an open position in which each of the top flaps 66,67 is spaced from the opposite side panel to provide access through the installation entrance 38 to the hollow interior volume 36 of the display sleeve 32. In the closed position, the top flaps 66,67 partially block the installation entrance 38 into the interior volume 36 of the display sleeve. The geometry of each of the top flaps 66,67 is designed to operably engage the top tab 62 when the top tab 62 is folded across the top tab fold line 64 and moved adjacent the front panel 52 when the top panel 42 is placed in the closed position. In the preferred embodiment, the outermost portion of the top tab fold line 64 has score lines 70. The combination of the top tab 62, top tab score lines 70, and the top flaps 66,67 cooperate to hold the top panel 42 in its closed position and releaseably secure the dispensing container 20 within the display sleeve 32. However, other arrangements of releaseably securing the top panel may be constructed by those skilled in the art.

In the preferred embodiment, the top panel 42 creates the installation entrance 38 and includes the access hole 40. Each of the top flaps 66,67 is provided with a curved distal edge 72 opposite each of the respective top flap hinge lines 68,69. The shapes of the distal edges 72 coincides and matches with the access hole 40 when the top flaps 66,67 are moved to their closed positions and the top panel 42 is moved to its closed position. In this way, the display sleeve 32 fully conceals and covers the exterior appearance 48 of the dispensing container except for the opening 24.

As shown in FIGS. 4, 5, and 6, each of the unitary blanks 104,205,306 for the display sleeve also includes the bottom panel 44. The construction of the bottom panel 44 is similar to that of the top panel 42; however, the bottom panel 44, preferably, is connected to the front panel 52 or the face panel opposite the face panel attached to the top panel 42. This allows for a more rigid structure when the blank is folded to create the box for the display sleeve 32. In this construction, the bottom panel 44 pivots with respect to the front panel 54 across a bottom panel hinge line 76 between an open position in which the bottom panel 44 is spaced from the back panel 54 and a closed position in which the bottom panel 44 spans across to the back panel 54 to block access into the hollow interior volume 36 of the display sleeve. The bottom panel 44 is also provided with a bottom tab 78, which folds at a bottom tab fold line 80 opposite the bottom hinge line 76 to releasably secure the bottom panel 44 in the closed position.

As shown in FIGS. 4, 5, and 6, each of the unitary blanks 104,205,306 includes left and right bottom flaps 82,83 attached to the respective left and right side panels 56,58 to reinforce the bottom panel 44. Each of the bottom flaps 82,83 is connected to each respective left and right side panel 56,58 at a bottom flap hinge line 84,85. The bottom flaps 82,83 are constructed in a similar fashion to the top flaps 66,67. Each of the bottom-end flaps 82 is pivotal about their bottom flap hinge lines 84,85 between an open position in which each of the bottom flaps 82,83 is spaced from the opposite side panel and a closed position in which each of the bottom flaps 82,83 extends from the respective hinge line 84,85 toward the opposite side panel. Differing from the top flaps, each of the bottom flaps 82,83 has a distal edge 86 opposite its respective bottom flap hinge line 84,85 that is straight and the bottom flaps 82,83 overlap each other when in the closed position to provide extra strength and rigidity for the box 41. This overlapping distributes the weight of the dispensing container that is held within the display sleeve 20 between the bottom panel 44 and the bottom flaps 82,83. The bottom flaps 82,83 are designed to operably engage the bottom tab 78 when the bottom tab 78 is folded across the bottom tab fold line 80 and the bottom panel 44 is placed in the closed position. Preferably, the bottom tab fold line 80 has score lines 88 at its outer most edges. These score lines 88 allow the bottom panel 44 to releaseably engage each of the bottom end flaps 82 when in the closed position. Thus, the combination of the bottom tab 78, the bottom tab score lines 88, and each of the bottom flaps 82,83 cooperate to releaseably secure the dispensing container 20 within the display sleeve 32. However, other arrangements of releaseably securing the bottom panel 44 may be constructed using box constructions known in the art.

FIGS. 4, 5, and 6 also show alternate embodiments of the panel engagement means. The blank in each figure shows an alternate construction for attaching the right panel 58 to the back panel 52 when the unitary blank 104,205,306 is folded to form the box of the display sleeve 32. FIG. 4 shows a blank 104, having a single tab 106 provided on the back panel 52. However, an alternate construction of the blank (not shown) incorporates the tab on the right side panel. When folding the blank 104 to form the box, the adjacent face panels are folded across panel partition fold lines 51 into the box, and the back panel tab 106 is folded across the back panel tab fold line 108 inwardly such that the back panel tab 106 is positioned adjacent the right side panel 58. Preferably, the tab 106 is placed on the interior side of the right side panel 58 and in the hollow interior volume 36 so as to provide a streamlined outer exterior for the display sleeve 32. Using adhesive or other securing means known in the art, the back panel tab 106 is affixed to the right side panel 58 thus connecting the back panel 54 to the right side panel 58.

FIG. 5 shows an alternate construction of the panel engagement means for the display sleeve 32. In the blank 205 of FIG. 5, two right side panel tabs 208 are provided extending from the right side panel 58 across right side panel tab fold lines 210. On the back panel 54, a back panel tab 212 is provided extending from the back panel 54 across a back panel tab fold line 214. The back panel tab fold line 214 has score lines 216 to create two, spaced-apart slots 218 that complement the right side panel tabs 208. To create the box for the display sleeve, the right side panel tabs 208 are folded inwardly across the right side panel tab fold lines 210 to bring the tabs 208 adjacent the back panel 54. The back panel tab 212 is folded inwardly across the back panel tab fold line 214 so that the score lines 216 open into the slots 218 to receive the tabs 208. The back panel tab is positioned adjacent the right side panel such that the tabs 212 are positioned to the interior side of the right side panel 58. Tabs 208 are then inserted into the slots 218. The back panel tab 212 cooperatively engages the tabs 208 and releaseably secures the right side panel 58 to the back panel 54. In an alternative construction (not shown), this system of tabs and slots can be reversed and incorporated on the opposite panels.

In the alternate construction for the panel engagement means shown in FIG. 6, the blank 306 contains a back panel inner tab 308, and a back panel outer tab 310 extending from the back panel 54 across a back panel tab fold line 312. The inner tab 308 is formed by a pattern of score lines 309 in the outer tab 310 such that the inner tab can be folded independently of the outer tab 310 across the back panel tab fold line 312. The blank 306 also contains a right side panel tab 314 extending from the right side panel 58 across a right side panel tab fold line 316. The back panel tab fold line 312 has score lines 318 extending away from both sides of the inner tab 308 to create a back panel slot 320 that complements the right side panel tab 314. The right side panel tab fold line 316 has a score line 322 that creates a right side panel slot 324 that complements the back panel inner tab 308. When the blank 306 is folded to create the box of the display sleeve 32, the back panel outer tab 310 is folded inwardly across the back panel tab fold line 312 such that the outer tab 310 is positioned adjacent the interior side of the right side panel 58 and the back panel slot 320 is exposed from the score line 318 in the back panel fold line 312. The inner tab 308 on the back panel is temporarily folded outward. The right side panel tab 314 is folded inward and inserted into the back panel slot 320. Folding the right side panel tab 314 inward also exposes the right side panel slot 324. The inner tab 308 is then inserted into the right side panel slot 324. In this system of tabs and slots, the outer side tab 310 cooperatively engages the right side panel tab 314, and the right side panel tab 314 cooperatively engages the inner tab 308. Thus, this system of complementing tabs and slots provides an alternative means for releaseably securing the right side panel to the back panel to form the box of the display sleeve 32. Other panel engagement means may also become apparent to those skilled in the art given the various types of containers formed from flat stock blank material.

Figure 7:
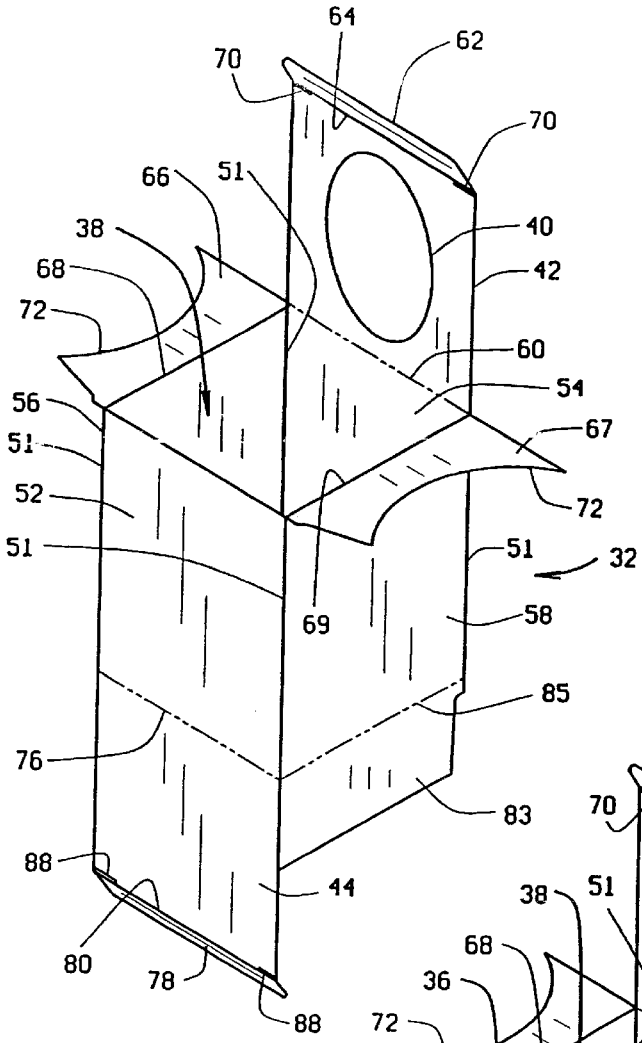
FIG. 7 is a perspective view of the display sleeve of FIG. 1 as it is folded from the blank to create a box shape.
Figure 8:
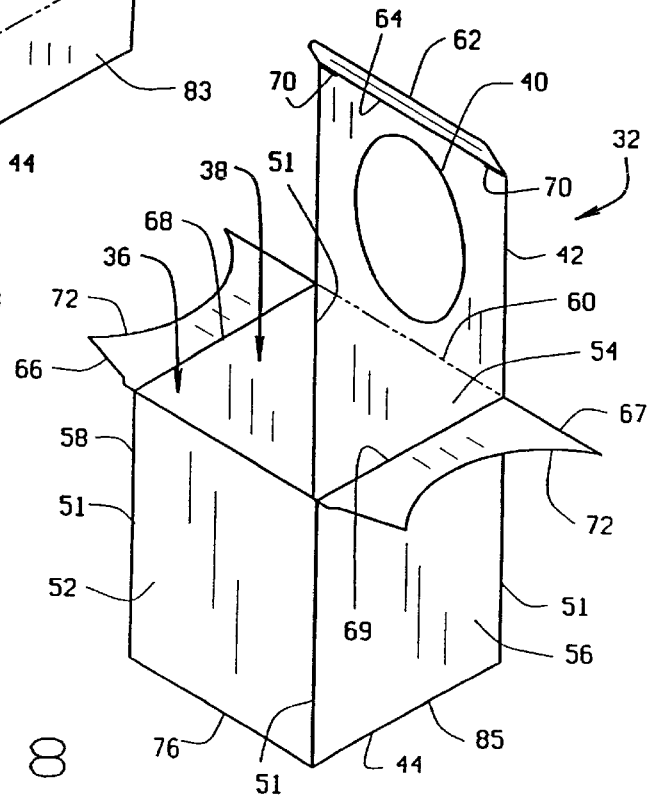
FIG. 8 is a perspective view of the display sleeve of FIG. 7 completely folded with the top panel in an open position and the top flaps in open positions to allow installation of the dispensing container of FIG. 1 into the internal volume of the display sleeve.

FIGS. 7 and 8 show the series of sequential folding operations to create the box of the display sleeve 32 of FIG. 1. In creating the display sleeve 32 shown in FIG. 7, the front and back panels 52,54 and left and right panels 56,58 are folded across the panel partition fold lines 51, and depending on the type of panel engagement means, the back panel 54 is connected and secured to the right side panel 58. As shown in FIG. 8, each respective top flap 66,67 is then pivoted or folded outwardly across its respective top flap hinge line 68,69 to fully open the installation entrance 38 into the interior volume 36 of the display sleeve. Each of the bottom flaps 82,83 is pivoted to their closed positions, and the bottom panel 44 is pivoted about its bottom panel hinge line 76 to its closed position. The bottom tab 78 is folded across the bottom tab fold line 80 as the bottom panel 44 is pivoted adjacent the back panel 54 so that the bottom tab 78 engages each of the bottom flaps 82,83 to releaseably secure the bottom panel 44 in the closed position. With the bottom panel 44 secured in the closed position, the hollow interior volume 36 of the display sleeve 32 is defined and the dispensing container 20 can be supported within the display sleeve 32. The dispensing container 20 can then be inserted into the hollow interior volume 36 of the display sleeve.

The dispensing container 20 is installed into the display sleeve 32 such that the dispensing opening 24 of the dispensing container is aligned to match with the access hole 40 in the top panel when the top panel 42 is moved to its closed position With the dispensing container 20 in place in the hollow interior volume 36 of the display sleeve, the top flaps 66,67 are folded inwardly to their closed positions. In doing so the curved distal edge 72 of each respective top flap coincides and matches with the dispensing opening 24 of the dispensing container. With each of the respective top flaps 66,67 in their closed positions, the top panel 42 is pivoted about its top panel hinge line 60 to its closed position. The top tab 62 is folded about the top tab fold line 64 such that the top tab 62 is positioned adjacent the interior of the front panel 52. The score lines 70 on the outer most portions of the top tab fold line 64 engage each of the respective top flaps 66,67, securing the top panel 42 in its closed position and securing the dispensing container 20 within the interior volume of the display sleeve 32.

Pivoting the top panel 42 to the closed position aligns and matches the access hole 40 with the distal edges 70 of each of the respective top flaps 66,67 and the opening 24 of the dispensing container 20. Thus, the exterior appearance 48 of the dispensing container is entirely concealed except for the opening 24. Because the interior volume 36 of the display sleeve closely matches the exterior dimensions of the dispensing container, the dispensing container 20 cannot shift around or move within the display sleeve 32.

With this invention, different patterns and graphic designs can be printed on the outer surfaces of the blank of the display sleeve. Therefore, the exterior appearance 48 of the dispensing container 20 can be altered and changed as desired by a user. Advertisements and other promotional items may be displayed on the outer surfaces of the display sleeve without purchasing a large production run of dispensing containers from the manufacturer or incurring a large one-time set-up charge from the manufacturer. The display of the present invention allows a user to inexpensively customize the exterior appearance 48 of the dispensing container. Moreover, if the graphical design produced by the manufacturer does not match or meet with the user's desires, the user can purchase a display sleeve with a graphical and artistic design that matches the user's interior decor. Since the top panel 42 is releaseably securable in the closed position and maintains the dispensing container 20 within the internal volume 36 of the display sleeve, emptied dispensing containers can be removed and new dispensing containers can be inserted within the same display sleeve 32.

As various changes could be made in the above construction without departing from the scope of the invention, it is intended that all matter contained in the above description and shown in the accompanying drawings shall be interpreted as illustrative and not in any limiting sense. The invention therefore shall be solely limited by the scope of the claims set forth below.

What is claimed is:

1. A method of changing an exterior appearance of a dispensing container box having exterior dimensions, the dispensing container box having an opening to allow contents of the dispensing container box to be passed from within the dispensing container box to outside the dispensing container box, the method comprising:

providing a display sleeve box having a desired exterior appearance;

inserting the dispensing container box into the display sleeve box interior volume such that the exterior appearance of the dispensing container box is concealed by the display sleeve box and the desired exterior appearance is displayed and such that the interior volume of the display sleeve box is filled with the dispensing container box;

providing an access hole in the display sleeve box and aligning the opening of the dispensing container box with the access hole provided in the display sleeve box whereby the access hole aligns with the opening to allow the contents of the dispensing container box to be passed from within the dispensing container box through the opening and the access hole to outside the display sleeve box;

securing the dispensing container box in the display sleeve box;

cutting the display sleeve box from a single unitary blank;

folding the single unitary blank into a box shape having a top panel and a bottom panel, and opposite left side and right side panels intermediate and alternating with opposite front and back panels, the left side and right side and the front and the back panels extending between the top and bottom panels thereby creating the interior volume whereby the dispensing container box is received in the interior volume;

cutting the display sleeve box left and right side panels with each having a top flap connected to the side panel at a top flap hinge line, with each of the top flaps being pivotable about the respective top flap hinge line between an open position exposing the interior volume of the display sleeve and a closed position partially covering the interior volume of the display sleeve;

the top panel is connected to a back panel at a top panel hinge line, the top panel being pivotable about the top panel hinge line between an open position exposing the interior volume of the display sleeve box and a closed position securing the dispensing container box in the display sleeve box, the step of securing the dispensing container box in the display sleeve box further comprising:

closing the top panel to operably engage each of the top flaps of the respective side panels previously placed in the closed position; and positioning the access hole in the top panel to coincide and match with the opening of the dispensing container box whereby the contents of the dispensing container box can be passed from within the dispensing container box to outside the display sleeve box.

2. The method of claim 1, further comprising:

dimensioning the display sleeve box with an interior volume that matches exterior dimensions of the dispensing container box whereby the display sleeve box restricts movement of the dispensing container box inserted into the interior volume of the display sleeve box.

* * * * *